United States Patent [19]

Reich

[11] 4,412,198

[45] Oct. 25, 1983

[54] ROTARY TRANSFORMER

[75] Inventor: Richard B. Reich, Algonquin, Ill.

[73] Assignee: S. Himmelstein and Company, Hoffman Estates, Ill.

[21] Appl. No.: 330,078

[22] Filed: Dec. 14, 1981

[51] Int. Cl.[3] ..... H01E 21/06

[52] U.S. Cl. ..... 336/120; 336/83; 336/122

[58] Field of Search ..... 336/83, 120, 122

[56] References Cited

U.S. PATENT DOCUMENTS

| | | | |
|---|---|---|---|
| Re. 26,501 | 12/1968 | Himmelstein et al. | 336/120 |
| 3,441,886 | 4/1969 | Tveter | 336/120 |
| 3,531,748 | 9/1970 | Tveter | 336/120 |
| 3,531,749 | 9/1970 | Tveter et al. | 336/120 |
| 3,611,230 | 10/1971 | Maake | 336/120 |
| 3,717,029 | 2/1973 | Tveter | 73/136 A |
| 3,961,526 | 6/1976 | Himmelstein | 73/136 A |

*Primary Examiner*—A. T. Grimley
*Assistant Examiner*—Susan Steward
*Attorney, Agent, or Firm*—Wood, Dalton, Phillips, Mason & Rowe

[57] ABSTRACT

A rotary transformer such as for use in a torque-meter structure arranged to have reduced cross talk between the excitation and signal transformer portions, and to have improved durability. In the illustrated embodiment, the air gaps of the transformer section are disposed outboard relative to each other, with the U-shaped cores opening away from each other toward outboard support bearings to provide a circuitous flux path and thereby reduce cross talk between the transformer sections. A two-piece housing structure minimizes dimensional errors in manufacture. The rotor support has a large axial mounting contact for improved accuracy and stability as a result of the short length of the core housing the improved structural arrangement.

13 Claims, 4 Drawing Figures

ROTARY TRANSFORMER

BACKGROUND OF THE INVENTION

1. Field of the Invention

This invention relates to rotary transformer structures and in particular to the mounting of the transformer sections in a rotary transformer structure.

2. Description of the Background Art

In one conventional commercial rotary transformer, the excitation and signal transformers are mounted to an annular support surrounding the rotary shaft. The support is journaled on the shaft by means of spaced roller bearings mounted inboard of the transformer sections. This structure is illustrated in U.S. Pat. No. 3,611,230 of Douglas Maake. Such structure has the serious disadvantage of placing the bearings relatively axially closely together, providing reduced accuracy in the support of the shaft. A number of other prior art patents illustrate different arrangements of the rotary transformer cores. Thus, in U.S. Pat. No. 3,441,886 of Richard S. Tveter, which patent is owned by the assignee hereof, the transformer core is shown to open radially inwardly.

Similarly, in U.S. Pat. No. 26,501, of Sydney Himmelstein et al, which patent is also owned by the assignee hereof, a multichannel rotary transformer is illustrated wherein each of the cores opens radially toward the rotary shaft. Radial barriers are disposed axially between pairs of cores.

In another form of rotary transformer illustrated in U.S. Pat. No. 3,531,748 of Richard S. Tveter et al, which patent is also owned by the assignee hereof, the U-shaped cores of the excitation and signal transformers open axially toward each other.

In still another patent of Richard S. Tveter, U.S. Pat. No. 3,717,029, which patent is also owned by the assignee hereof, the cores are arranged to open radially inwardly.

In U.S. Pat. No. 3,961,526 of Sydney Himmelstein, which patent is owned by the assignee hereof, the cores open axially toward each other.

SUMMARY OF THE INVENTION

The present invention comprehends an improved rotary transformer structure wherein the cores of the excitation and signal transformers are arranged to open axially away from each other.

The cores are mounted on an intermediate core housing in accurate, axially spaced relationship.

The improved transformer structure utilizes rotor support bearings disposed axially outboard of the transformer sections for improved accuracy and stability.

The improved rotary transformer structure provides reduced cross talk between transformer sections, while at the same time provides high durability in the rotary transformer structure.

The rotor support has a large axial extent for improved accuracy and stability for improved mounting of the rotatable portion of the transformer sections, as a result of a relatively short length of the core housing permitted by the novel structural arrangement.

The transformer arrangement of the present invention permits replacement of the bearings without disassembling of the rotary transformers for further facilitated maintenance and low cost manufacture.

The transformer structure may further be provided with means for providing a speed signal which also may be disposed inboard of the support bearings.

The rotary transformer illustratively may be used in a strain gage torquemeter providing high accuracy in the strain indications.

Thus, the rotary transformer structure of the present invention is extremely simple and economical of construction while yet providing the highly improved features and advantages discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
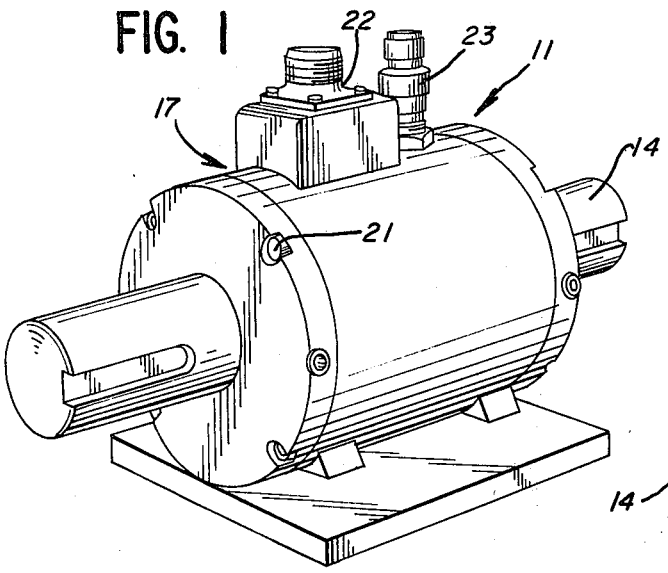
FIG. 1 is a perspective view of a noncontact strain gage torquemeter having an improved rotary transformer structure embodying the invention.
Figure 2:
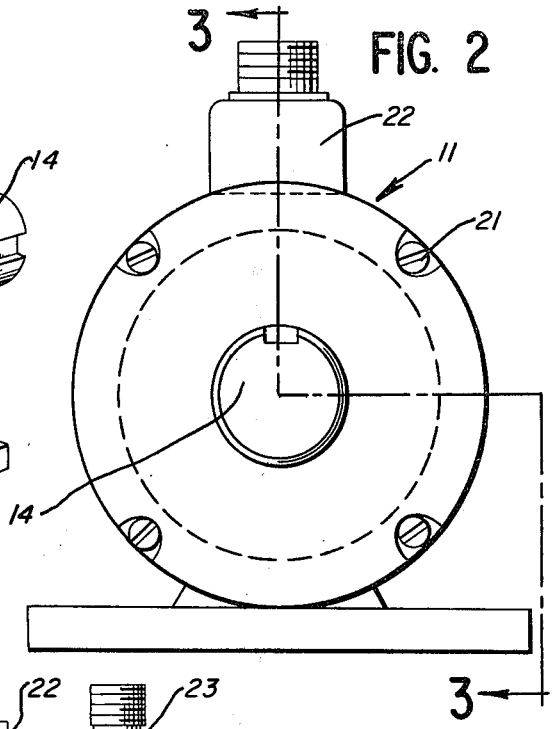
FIG. 2 is an end view thereof.

In the illustrative embodiment of the invention as disclosed in the drawing, an improved rotary transformer structure generally designated 10 provides an improved low cross talk transformer means for use in a wide range of instruments, such as the illustrated noncontact strain gage torquemeter generally designated 11. Such torquemeters provide high accuracy and dependability in providing continuous indications of transmitted torque, such as in engines, pumps, transmissions, motors, compressors, etc. Illustratively, the torque is determined by means of suitable strain gages 12 carried on a mounting portion 13 of a rotary shaft 14.

Figure 3:
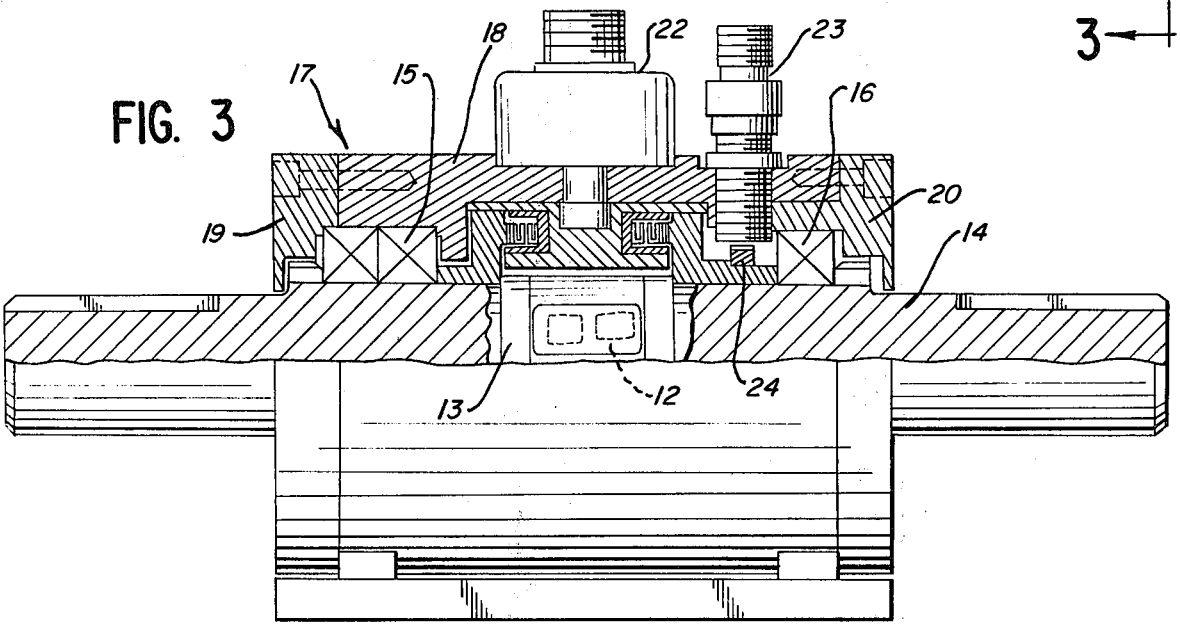
FIG. 3 is a diametric section thereof illustrating in greater detail the rotary transformer structure.

Shaft 14 is rotatably journaled in a pair of axially spaced bearings 15 and 16 mounted in a housing generally designated 17 including a tubular midportion 18 and end portions 19 and 20 secured to the midportion as by suitable bolts 21. As can be seen in FIG. 3, the bearings may be removed from the assembly by removal of the end portions 19 and 20 from the housing for facilitated maintenance of the torquemeter.

Electrical connections to the torquemeter may be provided through a connector 22 mounted on the housing portion 18, as best seen in FIG. 3. As further illustrated in FIG. 3, a speed sensor 23 may be provided as desired. In the illustrated embodiment, the speed sensor senses magnetic pulses produced by the rotation of a ferrous gear 24 with the shaft 14, in a conventional manner. As seen in FIG. 3, the speed sensor may be mounted inboard of the bearing 16.

Figure 4:
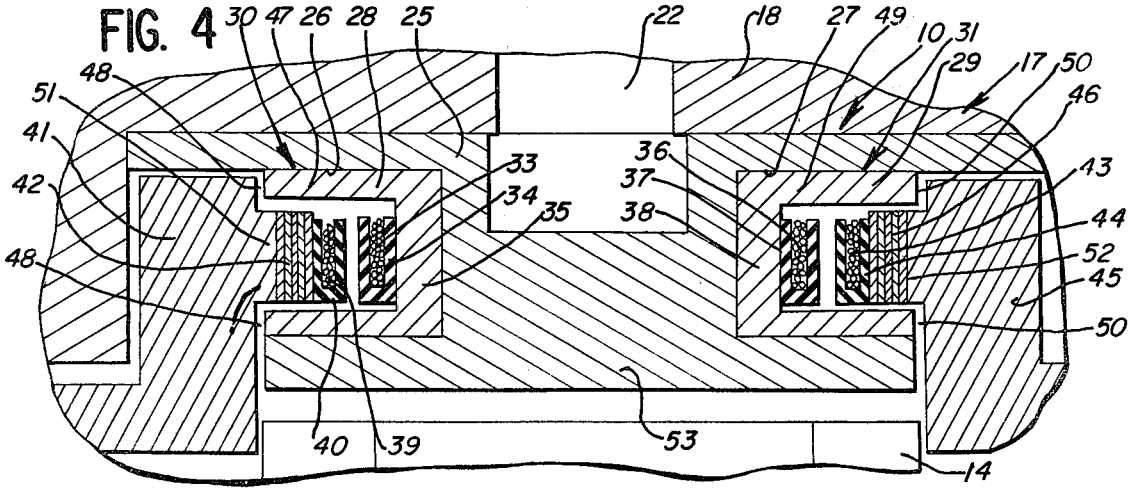
FIG. 4 is a fragmentary enlarged diametric section illustrating in further greater detail the arrangement of the rotary transformer structure.

Referring now more specifically to FIG. 4, the improved rotary transformer structure 10 of the present invention is shown to include an annular shield and ferrite core housing 25 defining a pair of axially spaced, axially outwardly opening recesses 26 and 27, in which are fixedly secured U-shaped magnetic cores 28 and 29, respectively. As shown in FIG. 4, the cores open away from each other parallel to the axis of shaft 14. The cores may be formed of suitable ferrite material, magnetic ceramic material, etc.

Illustratively, core 28 may define the core of the excitation transformer section generally designated 30, and core 29 may comprise the core of an output, or signal transformer section generally designated 31.

As shown, excitation section 30 includes a stator coil 33 would in a suitable U-shaped coil form 34 secured to the bight 35 of the U-shaped core 28. The signal transformer section 31 includes a stator coil 36 wound in a coil form 37 secured to the bight 38 of the core 29.

Rotor coil 39 of excitation transformer section 30 is wound in a suitable coil form 40 which is secured to the annular rotor support 41 by a plurality of thin split annular laminations 42 formed of a permeable material having high tensile strength, such as transformer steel. Rotor coil 43 of signal transformer section 31 is wound in a suitable coil form 44 secured to a rotor support 45 by a plurality of thin laminations 46 similar to laminations 42.

As seen in FIG. 4, the legs 47 of core 28 are spaced from rotor support 41 by a small air gap 48 and legs 49 of core 29 are spaced from rotor support 45 by a small air gap 50. In the illustrated embodiment, air gaps 48 and 50 comprise approximately 0.005" air gaps and, thus, are substantially smaller than the conventional air gaps utilized in such apparatuses which conventionally are in the order of over 10 to 20 times larger.

As can be seen from FIG. 4, as a result of the outwardly facing U-shaped core mounting in the axially spaced transformer sections 30 and 31, a relatively long and circuitous leakage flux path between the transformer sections is provided, thereby effectively minimizing undesirable cross talk while yet permitting the transformer sections to be disposed relatively axially closely together. Thus, as shown in FIG. 4, the leakage flux from transformer section 30 must pass through the relatively small air gap 48, through the space between insulating housing 25 and rotor shaft 14, and then through the relatively small air gap 50 to the transformer section 31.

As further illustrated in FIG. 4, rotor support 41 is provided with an axially inwardly projecting annular boss 51 and rotor support 45 is provided with an axially inwardly projecting annular boss 52 supporting the lamination stacks 42 and 43, respectively. As each of the bosses projects axially into the space between the legs 47 of core 28 and legs 49 of core 29, the leakage flux path is further extended for minimizing cross talk between the transformer sections.

As shown, bearings 16 are disposed outboard of the transformer sections so as to provide an improved journaling of the shaft 14. The improved housing structure 17 effectively minimizes dimensional errors in the manufacture of the transformer structure. As the core housing 25 is relatively short, additional axial length is available for mounting of the rotor supports 41 and 45 on shaft 14, thereby providing improved accuracy and stability.

As can be further seen in FIG. 4, the housing 25 defines a radially inner portion 53 spaced from shaft 14 and terminating substantially flush with the distal ends of the legs 47 and 49 of the cores 28 and 29, respectively. As each of the housing 25 and rotor supports is formed of a magnetically insulative material, cross-linking between the transformer sections is effectively minimized so as to correspondingly minimize undesirable cross talk therebetween. The novel arrangement of the transformer intermediate the bearings permits facilitated accurate manufacture, thereby substantially further improving the accuracy of the apparatus.

The foregoing disclosure of specific embodiments is illustrative of the broad inventive concepts comprehended by the invention.

I claim:

1. In a rotary transformer structure having at least one annular stator support, a rotor, at least one annular rotor support on said rotor, and a pair of annular bearings journaling said rotor in said stator support at axial spaced positions, improved transformer means including an annular excitation transformer having a first stator coil and a first rotor coil, and an annular signal transformer having a second rotor coil, a pair of annular cores each having a U-shaped cross section and being formed of a magnetically permeable material, said U-shaped cross section being defined by a bight portion and a pair of leg portions extending away from the bight portion parallel to the axis of the core, said excitation transformer being disposed in one core and the signal transformer being disposed in the other core, the improvement comprising:

means for mounting said cores to at least one of said supports intermediate said spaced bearings with said bight portions in axially spaced relationship and the legs of each core extending axially away from the other core toward the bearing outboard thereof; and opposed permeable means extending toward each other radially intermediate said ends of the legs of the respective cores and defining small air gaps with said leg ends to cooperate with said U-shaped cores in substantially fully permeably enclosing the transformers and defining air gaps opening axially away from the other of said pair of cores whereby cross talk between said transformers is effectively minimized notwithstanding the disposition of the transformer inboard of said spaced bearings, each pair of associated permeable means and U-shaped core being mounted for coaxial relative rotation therebetween.

2. The rotary transformer structure of claim 1 wherein said cores are carried by said stator support.

3. The rotary transformer structure of claim 1 wherein said cores are mounted to the same support.

4. The rotary transformer structure of claim 1 wherein each of said permeable means is spaced axially inwardly from the distal end of the core legs.

5. The rotary transformer structure of claim 1 wherein the support carrying the core defines magnetically insulative means radially inwardly and radially outwardly of said legs.

6. The rotary transformer structure of claim 1 wherein the support carrying the core defines magnetically insulative means radially inwardly and radially outwardly of said legs and extending axially at least to the distal end of said legs away from the bight portion of the core.

7. The rotary transformer structure of claim 1 wherein the support carrying the core defines magnetically insulative means radially inwardly and radially outwardly of said legs, at least a portion of the insulative means extending substantially beyond the distal end of one of said legs away from the bight portion of the core.

8. The rotary transformer structure of claim 1 wherein the support carrying the core defines magnetically insulative means radially inwardly and radially outwardly of said legs, at least one portion of the insulative means terminating substantially flush with the distal end of one of said legs.

9. The rotary transformer structure of claim 1 wherein one of said supports defines a pair of axially spaced annular portions and the other of said supports defines an annular portion disposed axially intermediate said spaced annular portion.

10. The rotary transformer structure of claim 1 wherein one of said supports defines a pair of axially spaced annular portions and the other of said supports defines an annular portion disposed axially intermediate said spaced annular portion, said pair of cores being mounted to the same support.

11. The rotary transformer structure of claim 1 wherein one of said supports defines a pair of axially spaced annular portions and the other of said supports defines an annular portion disposed axially intermediate said spaced annular portion, said pair of cores being mounted to said other of said supports to open axially toward said spaced annular portion of said one of said supports.

12. The rotary transformer structure of claim 1 wherein the rotary transformer structure includes a pair of axially spaced annular rotor supports, and an annular stator support axially intermediate said spaced rotor supports, said cores being mounted to said stator support.

13. The rotary transformer structure of claim 12 wherein said rotor supports include annular portions extending coaxially into the annular space between the ends of the core legs.

* * * * *